United States Patent [19]

Kabat

[11] 4,017,852

[45] Apr. 12, 1977

[54] APPARATUS FOR SUPERVISING LEADS INTERCONNECTING A PLURALITY OF SELF-CONTAINED ABNORMAL CONDITION SENSING AND ALARM ANNUNCIATING UNITS

[75] Inventor: John L. Kabat, Bloomington, Minn.

[73] Assignee: Honeywell Inc., Minneapolis, Minn.

[22] Filed: June 24, 1976

[21] Appl. No.: 699,420

[52] U.S. Cl. ..... 340/409; 340/253 B

[51] Int. Cl.[2] ..... G08B 17/00

[58] Field of Search ..... 340/213 R, 227 R, 237 R, 340/253 R, 253 B, 409, 418

[56] References Cited

UNITED STATES PATENTS 3,711,854 1/1973 Reynolds et al. ..... 340/253 B

*Primary Examiner*—Alvin H. Waring
*Attorney, Agent, or Firm*—Roger W. Jensen

[57] ABSTRACT

Circuitry associated with a self-contained abnormal condition sensing and alarm annunciating unit for supervising or monitoring leads interconnecting a plurality of such units and for responding to an open circuit condition of such leads so as to actuate an annunciator in a distinctive fashion to signal the open circuit condition.

4 Claims, 2 Drawing Figures

APPARATUS FOR SUPERVISING LEADS INTERCONNECTING A PLURALITY OF SELF-CONTAINED ABNORMAL CONDITION SENSING AND ALARM ANNUNCIATING UNITS

BRIEF SUMMARY OF THE INVENTION

This invention relates to alarm systems comprising a plurality of self-contained abnormal condition sensing and alarm annunciating units wherein each of the units comprises an alarm annunciator, a source of electric power, and a means such as a normally open switch means connecting the alarm annunciator to the source of power. The sensing and alarm annunciating units further include a condition sensing means operationally connected to the normally open switch means and responsive to an abnormal condition for causing the normally open switch means to close to thereby allow or permit electric current to flow through the alarm annunciator to thereby annunciate an alarm. Ionization type smoke detectors, which are in widespread use, are examples of such self-contained abnormal condition sensing (smoke) and alarm annunciating units.

It is frequently desirable to interconnect a plurality of such units in such a way so that operation of the condition sensing means of any of the units, in response to an abnormal or smoke condition, will function to actuate the alarm annunciators of all of the units. Consider for example, a residential dwelling with one smoke detector unit located in or adjacent to the bedrooms or sleeping rooms, a second unit located in a basement or utilities area, and a third unit located in the living room area. If a fire were to start in the basement area so as to produce smoke, the smoke detector in that area would detect such smoke and would function to operate not only the alarm annunciator associated therewith but also, through the interconnecting means to the other smoke detectors, function to actuate those alarms as well. Thus, if the fire started at night when the occupants were in the bedroom zone, the actuation of the alarm in the bedroom area would awaken those occupants, giving them a better opportunity to escape the building. If the only alarm sounding for this situation were the alarm in the basement area, it is quite possible that the occupants in the bedroom zone would not be awakened.

It will be appreciated, therefore, that it is essential for the integrity of the system to have reliable interconnecting means linking the plurality of sensing and alarm units. The occupants of the building protected by such detectors could be lulled into a false sense of security if, unbeknownst to them, the interconnecting leads were open; i.e., did not have continuity.

There have been prior art arrangements for line supervision or monitoring, but these prior arrangements are subject to various disadvantages.

The present invention pertains to an inexpensive but effective and reliable apparatus for monitoring the lines interconnecting a plurality of units and for annunciating, in a distinctive manner, an open line.

BRIEF DESCRIPTION OF THE DRAWINGS

FIG. 1 also depicts an interconnect line supervision circuit embodying the principles of my invention.

DETAILED DESCRIPTION

Figure 1:
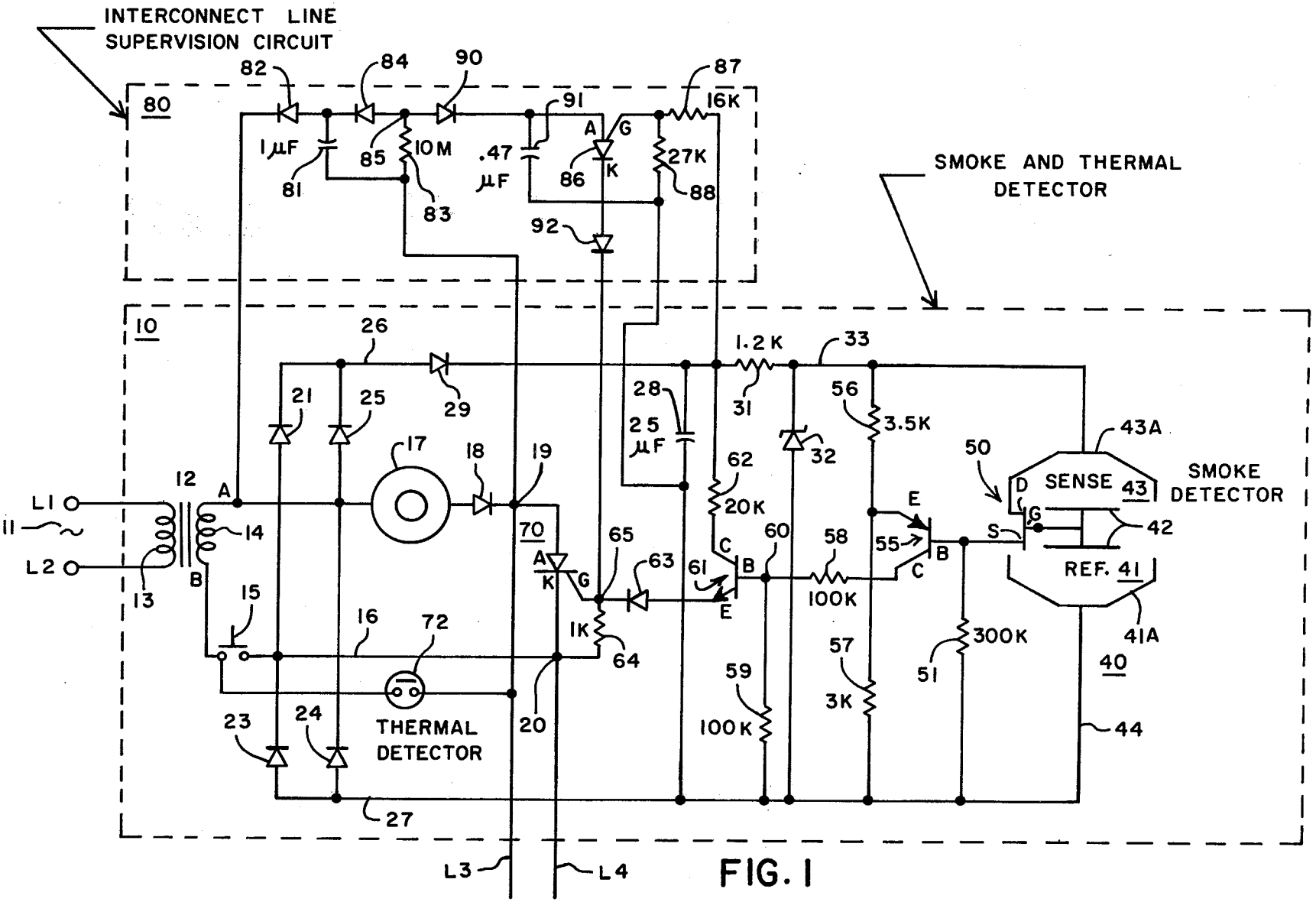
FIG. 1 depicts a self-contained abnormal condition sensing and alarm annunciating unit, ambient smoke and/or high temperatures being the abnormal conditions to be sensed.

In FIG. 1, the reference numeral 10 generally depicts a self-contained abnormal condition sensing and alarm annunciating unit adapted to respond to the abnormal conditions of ambient smoke and/or ambient high temperatures. The expression "self-contained" is used to designate the characteristic of the unit having its own source of alternating current electric power and its own alarm annunicator in contrast, for example, to units which actuate a remotely located alarm annunciator.

Unit 10 comprises a transformer 12 having a primary winding 13 and a secondary winding 14, primary winding 13 having terminals L-1 and L-2 adapted to be connected to a suitable source 11 of alternating current such as 120 volts.

One end B of secondary winding 14 is connected through a unit cover safety switch 15 to a power bus 16. Switch 15 is closed when the unit cover is on and open when the cover is removed. The other end A of the secondary winding 14 is connected to one side of an alarm annunciator, or horn 17, the other side of which is connected by a diode 18 to a terminal 19 and a first interconnecting lead L-3. A second interconnecting lead L-4 is connected to power bus 16 and a terminal 20. A plurality of diodes 21, 22, 23 and 24 are connected in the well-known manner between bus 16 and end A of secondary winding 14 to provide full wave rectified power to a pair of DC power buses or leads 26 and 27, the voltage on lead 26 being positive with respect to that on lead 27. A filter capacitor 28 is connected between leads 26 and 27. A light emitting diode 29 is connected in series in line 26 to provide a visual indication of power being applied to the unit. A resistor 31 and a zener diode 32 are connected in series across leads 26 and 27 to provide a regulated voltage, e.g., 20 volts, across the zener diode, the regulated voltage appearing on leads 27 and 33.

Reference numeral 40 designates an ionization type smoke detector of the well-known type comprising a reference chamber 41, a central electrode 42, and a sensing chamber 43. The cup-shaped housing or shell 41A of reference chamber 41 is connected through a lead 44 to lead 27 and the cup-shaped housing or shell 43A of sensing chamber 43 is connected to power lead 33 so that when power is applied to leads L-1 and L-2 a regulated voltage, e.g., 20 volts DC, is applied across the smoke detector unit 40. The center electrode 42 is connected to the gate G of a junction field effect transistor (FET) 50, the drain D of which is electrically connected to the shell or housing 43A of sensing unit 43, and the sink S of which is connected through a resistor 51 to lead 27 and also to the base of a PNP transistor 55. The emitter of transistor 55 is suitable biased by being connected to the junction of a pair of resistors 56 and 57 connected in series between lines 33 and 27. The collector of transistor 55 is connected to line 27 through a pair of series connected resistors 58 and 59, the junction 60 therebetween being connected to the base of a current amplifier NPN transistor 61, the collector of which is connected through a resistor 62 to line 26 and the emitter of which is connected through a diode 63 and a resistor 64 to junction 20 and interconnecting lead L-4. The junction between resistor 64 and diode 63 is identified by reference numeral 65.

A normally open switch means 70 is connected across junctions 19 and 20 and thus between interconnecting leads L-3 and L-4, the switch means being depicted in FIG. 1 to be a silicon controlled rectifier (SCR), having its anode connected to junction 19 and lead L-3, its cathode connected to junction 20 and lead L-4, and its gate connected to junction 65. Resistor 64 thus constitutes a control means for SCR 70.

A normally open switch type thermal detector 72 is connected between junction 19 and end B of secondary winding 14 of transformer 12.

In FIG. 1 the reference numeral 80 is used to designate the interconnect line supervision circuit which comprises in part a capacitor 81 and a diode 82 connected in series between junction 19 and end A of secondary winding 14. A resistor 83 and a diode 84 are connected in series across capacitor 81. The line supervision circuit further comprises a programmable unijunction transistor (PUT) 86, the gate G of which is biased by being connected to the junction between a pair of series connected resistors 87 and 88 which are connected between leads 26 and 27. The anode A of PUT 86 is connected by a diode 90 to the junction 85 between resistor 83 and diode 84; the anode is also connected through a capacitor 91 to lead 27. The cathode K of PUT 86 is connected through a suitable diode 92 to junction 65.

Figure 2:
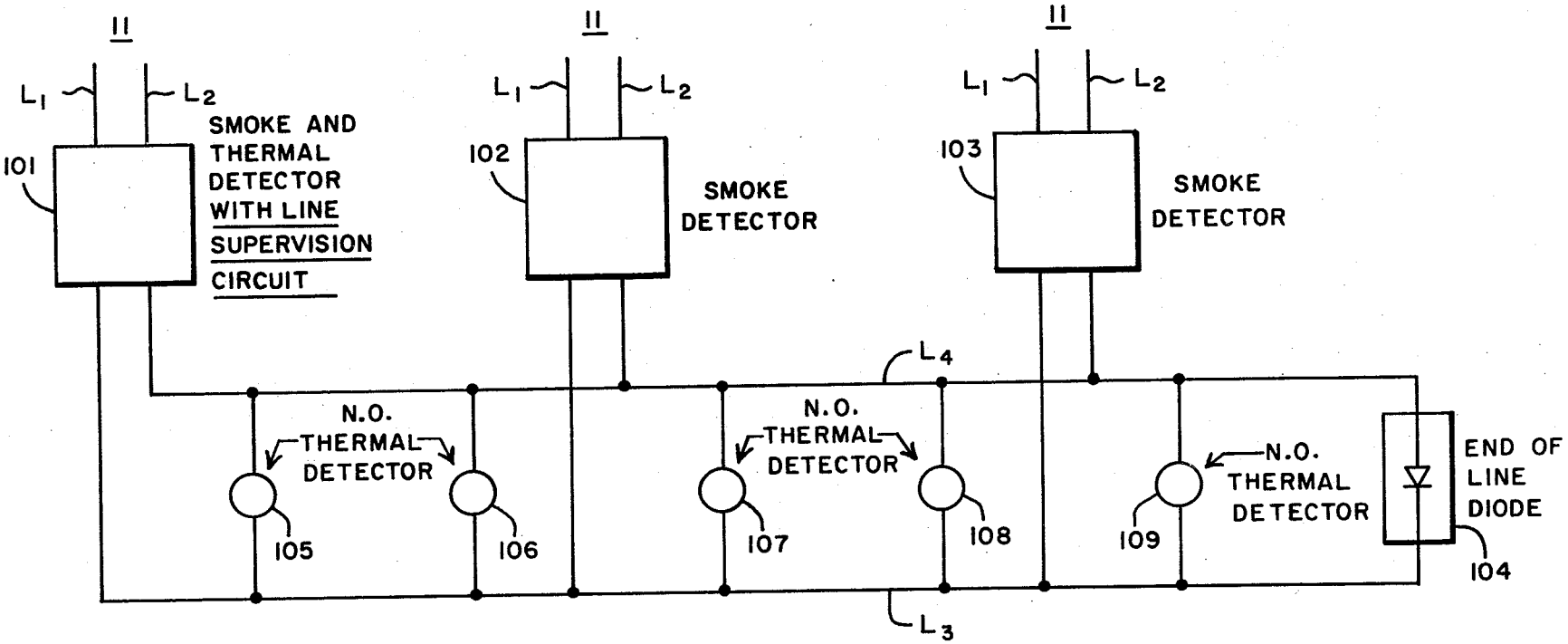
FIG. 2 depicts a plurality of self-contained abnormal condition sensing and alarm annunciating units interconnected by a pair of interconnecting leads.

In FIG. 2 a plurality of smoke and thermal detectors 101, 102, and 103 are depicted, each of which would comprise a unit similar to unit 10 depicted in FIG. 1 and at least one of which, i.e., unit 101, would also comprise an interconnect line supervision circuit 80. The units 101, 102 and 103 receive energization from suitable alternating current power supplies through their terminal leads L-1 and L-2 and each is connected to the interconnect lines L-3 and L-4. More specifically, the interconnect lines L-3 and L-4 are connected to junctions 19 and 20 of each of the units and are thus connected to opposite sides of the normally open switch means, SCR 70. An end of line diode 104 is connected at the end of leads L-3 and L-4 and is poled opposite to the diodes 18 in the units 10. The overall system may further include a plurality of normally open thermal detectors 105–109 connected across leads L-3 and L-4, each of which is adapted to respond to a preselected ambient temperature so as to change from its normally open condition to a closed condition so as to complete a circuit.

OPERATION

Referring to FIG. 1, it may be assumed that leads L-1 and L-2 are receiving the indicated alternating current energization so as to energize the device 10. This will produce, in the manner indicated, a regulated direct current voltage applied across the sensing unit 40. In the absence of any smoke, the sensing and reference chambers 43 and 41 will have substantially equal impedences so that the gate G of FET 50 will be at a preselected potential; e.g., positive 10 volts. The connection of FET 50 as shown constitutes a source follower so that the voltage at its source S or across resistor 51 tends to follow the potential applied to the gate G thereof. Transistor 55 as connected constitutes a normally non-conducting switch, the emitter thereof being normally biased negative with respect to the normal potential at the base thereof. When smoke is detected in the sensing chamber 43, the impedence thereof increases in the well known manner so that the positive potential of the center electrode 42 decreases, and since this potential is applied to the gate G of FET 50, the potential on the base of transistor 55 will also be decreased, because of the described source follower function of FET 50. When this voltage has decreased sufficiently, normally non-conducting transistor 55 will conduct, permitting a current flow from lead 33 through resistor 56, transistor 55, and resistors 58 and 59 to negative lead 27. This will apply a signal to the current amplifier transistor 61, the output of which is applied through the control resistor 64 of the SCR, or normally open switch means 70. The current flow through resistor 64 will function to turn on SCR 70, thus completing an energization circuit for the alarm annunciator or horn 17, said circuit being traced from end A of secondary winding 14 through horn 17, diode 18, junction 19, SCR 70 (from anode to cathode), junction 20, lead 16, switch 15, to terminal B of secondary winding 14. Thus, half wave power is applied to horn 17 producing a continuous alarm as long as smoke is detected in the sensing chamber 43. Through interconnecting leads L-3 and L-4, the closing of switch 70, i.e., the enabling of SCR 70, also functions to sound the alarms in the remotely located detectors 102 and 103 by completing the energization circuits thereof.

If the thermal detector 72 detects an abnormally high ambient temperature, its normally open contacts will close, thus completing a circuit for the horn 17. In the same manner, if any of the remotely located thermal detectors 105–109 individually respond to a locally abnormally high ambient temperature, then the normally open contacts thereof will close so as to complete a circuit across the interconnecting leads L-3 and L-4 so as to cause all of the annunciators or horns 17 to be actuated and sound an alarm.

One of the functions of the interconnect line supervision circuit 80 is to complete a circuit for current flow through the end of line diode 104. When terminal B of secondary winding 14 is positive, then a circuit is completed therefrom through switch 15, line 16, line L-4, diode 104, lead L-3, resistor 83, diode 84, diode 82 to end A of secondary winding 14. Substantially all of the voltage drop in the circuit is across resistor 83 the effect of which is to charge capacitor 81 to the same voltage. On alternate half cycles (when end A of secondary winding 14 is positive) there will be a tendency for current flow to try to flow through horn 17, diode 18, resistor 83, diode 90 and capacitor 91 to lead 27 and diode 23 to end B of secondary winding 14; however, this current flow cannot take place as long as there is a charge on capacitor 81 because during the aforesaid alternate half cycle the capacitor 81 will tend to discharge through resistor 83 and diode 84.

However, if the lines L-3 and L-4 have a discontinuity so that no current flows through the end of line diode 104, then capacitor 81 will not be charged in the manner as aforesaid by the half cycles of current when end B of secondary winding 14 is positive. For an open line condition, when end A of secondary winding 14 is positive, then current flow will occur through capacitor 91 and resistor 83 as aforesaid so that after a period of cycles capacitor 91 will be charged to a point where the potential on the anode A of PUT 86 is sufficiently positive so as to cause PUT 86 to conduct from the anode through the cathode thereof and thence through diode 92, junction 65 and resistor 64 thus firing the SCR 70 to actuate the horn 17. As soon as PUT 86 conducts, capacitor 81 begins to discharge therethrough, and PUT 86 will thus conduct only briefly, i.e., only the time required, to discharge the capacitor 91. Thus SCR 70 is closed only for a relative short period of time, thus producing a short alarm on the horn 17. Capacitor 91 immediately begins to recharge through resistor 83, and after a short delay, the potential on the anode of PUT 86 once again is sufficiently positive so that PUT 86 once again conducts repeating the cycle. The horn 17 thus will be intermittently energized by the intermittent opening and closing of the switch means 70. The frequency is determined by the time constant of the charging of capacitor 91, i.e., by the values of capacitor 91 and resistor 83. This intermittent operation of the annunciator 17 thus is a coded signal to the occupant of the premises in which these units are installed, advising the occupant that the interconnecting leads L-3 and L-4 have discontinuity therein so that corrective repairs may be made. Representative values of the resistors and capacitors are shown in FIG. 1. The diodes may be of the 1N645 type FET 50 may be the 2N4119A type; transistor 55 may be a 2N4250; transistor 63 may be a 2N3417; PUT 86 may be a 2N6027; and SCR 70 may be a C106F1. The zener 32 may be of the 1N968B type.

Those skilled in the art will recognize that the preferred embodiment of the invention disclosed herein may be altered and modified without departing from the true spirit and scope of the invention as defined in the following claims.

I claim:

1. An alarm system comprising:

a. a plurality of self-contained abnormal condition sensing and alarm annunciating units with each of said units comprising:

i. a pair of terminals adapted to be connected to a source of alternating current electric power;

ii. an alarm annunciator;

iii. normally open switch means;

iv. condition sensing means including means connected to said normally open switch means and responsive to an abnormal condition for causing said normally open switch means to close;

v. diode means; and vi. means connecting said annunciator, said diode means and said normally open switch means in series and to said terminals whereby closing of said normally open switch means functions to allow half wave current to flow through said alarm annunciator to thereby annunciate an alarm;

b. a pair of leads interconnecting said plurality of units, said leads being connected respectively to opposite sides of said normally open switch means of said units whereby operation of the condition sensing means of any of said units in response to an abnormal condition functions to close its associated switch means to thus actuate the alarm annunciators of all of said units;

c. second diode means connected across said interconnecting leads and poled in opposition to said first-recited diode means; and d. line supervision means integral with at least one of said units and being connected to said interconnecting leads and to the normally open switch means of said one of said units, said line supervision means including circuit means which cause half wave current flow through said second diode means as long as there is line continuity in said interconnecting leads, said circuit means further having means responsive to an interruption of such half wave current flow through said second diode means so as to cause said one of said normally open switch means to intermittently close and open to thereby actuate its associated alarm annunciator to produce an intermittent alarm.

2. Apparatus as claimed in claim 1 wherein said circuit means of said line supervision means includes:

a first capacitor and third diode means connected in series between one of said leads and one of the terminals of the unit which includes said one of said normally open switch means;

a resistor and fourth diode means connected in series across said first capacitor, said first capacitor being normally charged by half wave current flow through said second diode means and through said resistor to a voltage substantially equal to the voltage drop across such resistor resulting from such half wave current flow, said first capacitor tending to discharge through said resistor and fourth diode means during the half cycles when current does not flow through said second diode means so as to maintain a voltage drop across said resistor, the time constant of the discharge path for said first capacitor being longer than the intervals between successive half cycles of current flow so that said first capacitor will maintain a substantial amount of charge as long as there is a line continuity in said interconnecting leads, and additional switch means connected to said resistor and to said one of said normally open switch means and responsive to the discharge of said first capacitor so as to cause said one of said normally open switch means to close to thereby actuate its associated alarm annunciator.

3. Apparatus as claimed in claim 2 wherein said additional switch means includes:

a second capacitor connected to said resistor and to the other terminal of the unit which includes said one of said normally open switch means, said second capacitor being charged through said resistor upon an interruption of current flow through said second diode means, and a programmable unijuncton transistor connected to said second capacitor and to said one of said normally open switch means, said transistor being normally biased to be non-conducting and being responsive to a charging of said second capacitor to thereby conduct to discharge said second capacitor and to cause said one of said normally open switch means to close.

4. A self-contained condition sensing unit for use in a system comprising a plurality of condition sensing units interconnected by a pair of leads having connected thereacross first diode means wherein said self-contained condition sensing unit comprises the following:

a. a pair of terminals adapted to be connected to a source of alternating current electric power;

b. an alarm annunicator;

c. normally open switch means;

d. condition sensing means including means connected to said normally open switch means and responsive to an abnormal condition for causing said normally open switch means to close;

e. second diode means;

f. means connecting said annunciator, said second diode means and said normally open switch means in series and to said terminals whereby closing of said normally open switch means functions to allow half wave current to flow through said alarm annunciator to thereby annunciate an alarm; and g. line supervision means adapted to be connected to said interconnecting leads and connected to said normally open switch means, said line supervision means including circuit means which cause half wave current flow through said first diode means as long as there is line continuity in said interconnecting leads, said circuit means further having means responsive to an interruption of such half wave current flow through said first diode means so as to cause said normally open switch means to intermittently close and open to thereby actuate said alarm annunciator to produce an intermittent alarm.

* * * * *